United States Patent [19]

Berry et al.

[11] 4,083,544

[45] Apr. 11, 1978

[54] OXYGEN LANCE ASSEMBLY

[75] Inventors: William W. Berry, Pittsburgh; Leo L. Meinert, Beaver; Nicholas M. Rymarchyk, Pittsburgh, all of Pa.

[73] Assignee: Pullman Berry Company, Harmony, Pa.

[21] Appl. No.: 795,248

[22] Filed: May 9, 1977

[51] Int. Cl.[2] ..... C21C 5/32

[52] U.S. Cl. ..... 266/225

[58] Field of Search ..... 266/225, 226; 239/132.3

[56] References Cited

U.S. PATENT DOCUMENTS 3,972,515 8/1976 Mercatoris ..... 266/225

*Primary Examiner*—Gerald A. Dost

*Attorney, Agent, or Firm*—Thomas G. Anderson

[57] ABSTRACT

An oxygen lance assembly includes a top connector member having oxygen and water inlet and outlet pipes communicating with the slotted openings of a first connector plate assembly. A second connector plate assembly includes complementary slots in a flat plate which is quickly connected and released by means of a quick disconnect arrangement. The second connector assembly includes oxygen, water inlet and outlet pipes communicating with the slots. O-ring seals are positioned to prevent leakage of oxygen into the water pipes, or the leakage of water into the oxygen pipe. Any leakage which might occur is efficiently vented to the atmosphere.

9 Claims, 7 Drawing Figures

OXYGEN LANCE ASSEMBLY

CROSS-REFERENCES TO RELATED PATENT APPLICATIONS

The instant patent application is related to the following five co-pending patent applications which were filed in the patent office on the same date as the instant application:

Ser. No. 795,243 Filed May 9, 1977
Ser. No. 795,244 Filed May 9, 1977
Ser. No. 795,245 Filed May 9, 1977
Ser. No. 795,247 Filed May 9, 1977
Ser. No. 795,246 Filed May 9, 1977

BACKGROUND OF THE INVENTION

1. Field of Invention

The invention relates to oxygen lances used in the smelting of steel within basic oxygen furnaces. More specifically the invention relates to an oxygen lance assembly which may be easily disconnected from a support head mounted on a lance support carriage.

2. Description of the Prior Art

Patents of the prior art include U.S. Pat. Nos. 3,620,455 Nov. 16, 1971; 3,827,632 Aug. 6, 1974; 3,912,244 Oct. 14, 1975; RE: 28,769 Apr. 13, 1976 and 3,972,515 Aug. 3, 1976. The present invention is an improvement over these patents.

SUMMARY OF THE INVENTION

In the present invention a top support assembly, which is supported on a lance carriage, includes an oxygen pipe adapted to connect to a source of oxygen and water inlet and outlet pipes. A first connector assembly and annular plate connected to the pipes includes circumferential slots communicating with said pipes. A second connector plate having oxygen pipes and water inlet and outlet pipes also by means of similar complemental slots in said second plate communicates with said first slots when the connector plates are clamped together in relative sealing relation by means of a quick-connect-disconnect locking arrangement. The arrangement permits the second connector plate assembly and connected pipes to be quickly removed for repair and replacement purposes. By the inclusion of O-ring seal in the critical areas the leakage of oxygen into water pipes and vice versa is virtually eliminated. Any possibility of leakage of individual O-rings is remote but if it occurs a venting arrangement is strategically placed to vent the leakage to the atmosphere.

DESCRIPTION OF THE PREFERRED EMBODIMENT

Figure 1:
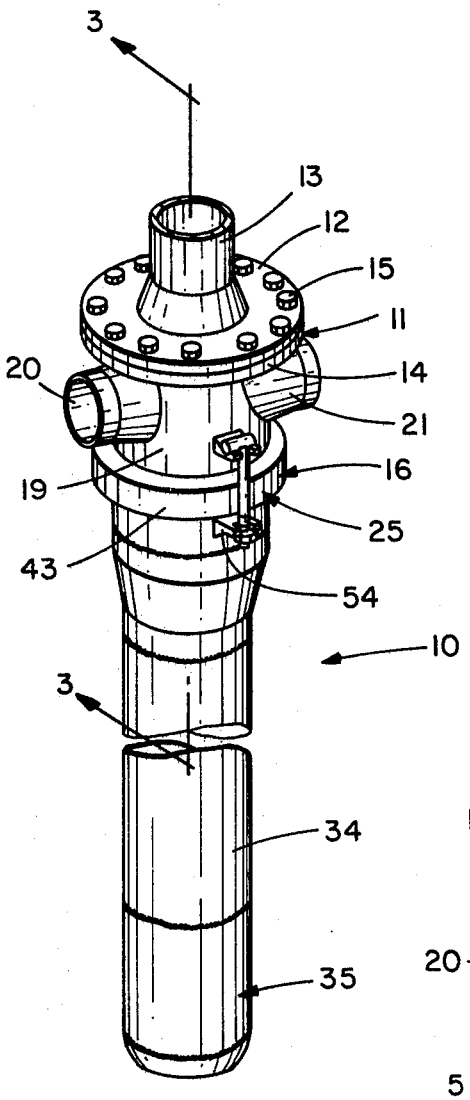
FIG. 1 is a perspective view of an improved oxygen lance.
Figure 2:
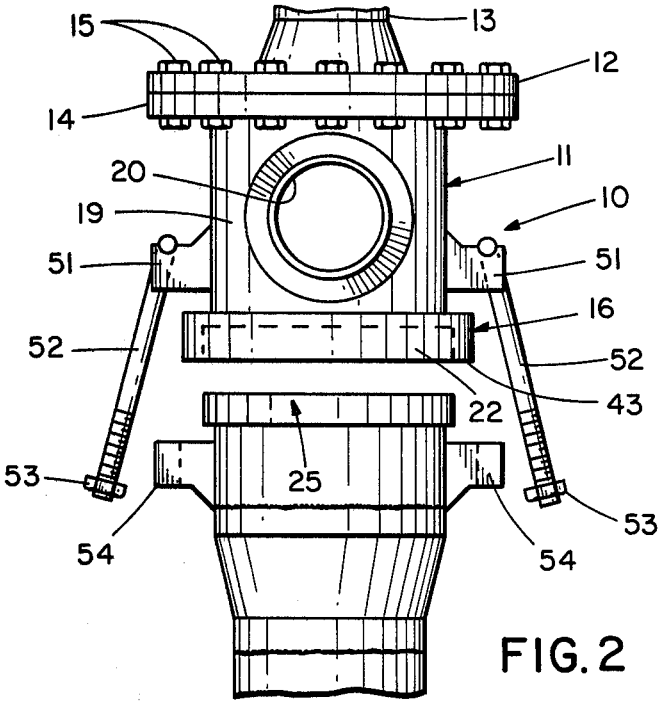
FIG. 2 is an elevational view of the upper end of the lance of FIG. 1.

An oxygen lance assembly 10 comprises a top support member 11 including a top plate 12 having an oxygen connector fitting 13 adapted to connect to an oxygen source. An annular plate 14 is connected by means of bolts and nuts 15 to the plate 12. The annular plate 14 and a first connector plate assembly 16 have connected thereto a first oxygen pipe 17, a second inlet water pipe 18 and a third outlet water pipe 19. A water inlet connector 20 communicates with the pipe 18 and an outlet connection 21 communicates with the outlet pipe 19. The first connector plate assembly 16 includes a flat plate 22 to which the lower ends of the pipes 17, 18 and 19 are connected. The plate 22 includes vertical circumferentially disposed arcuate slots 23 and 24. The term "circumferentially disposed" means annulously positioned or positioned in ringlike manner though not necessarily in any specific manner. The slots are arcuate in shape and have adjacent ends positioned from other adjacent ends in laterally spaced relation.

A second connector plate assembly 25 includes a flat plate 26 having an upper flat surface 27 which includes slots 28 and 29 communicating with slots 23 and 24 respectively.

A fourth oxygen pipe 30 is connected to the plate 26 and communicates with the pipe 17 through opening 31 in plate 26 and opening 32 in plate 22. A fifth water inlet pipe 33 communicates with slots 28 and a sixth water outlet pipe 34 communicates with slots 29.

A nozzle for the lance is designated at 35 and includes an outlet orifice 36 communicating with an oxygen stub pipe 37 which at its upper end is in telescoping slip fit connection with the lower end of pipe 30. A pair of O-rings 38 in engagement with the oxygen stub pipe provide for sealing of the slip joint. A water chamber 39 is in communication with an inlet stub pipe 40 having a slip fit relation with the lower end 41 of the water inlet pipe.

The plate 22 is provided with a flat lower surface 42 and includes a peripheral flange 43 which extends around and overlaps the plate 26.

Figure 4:
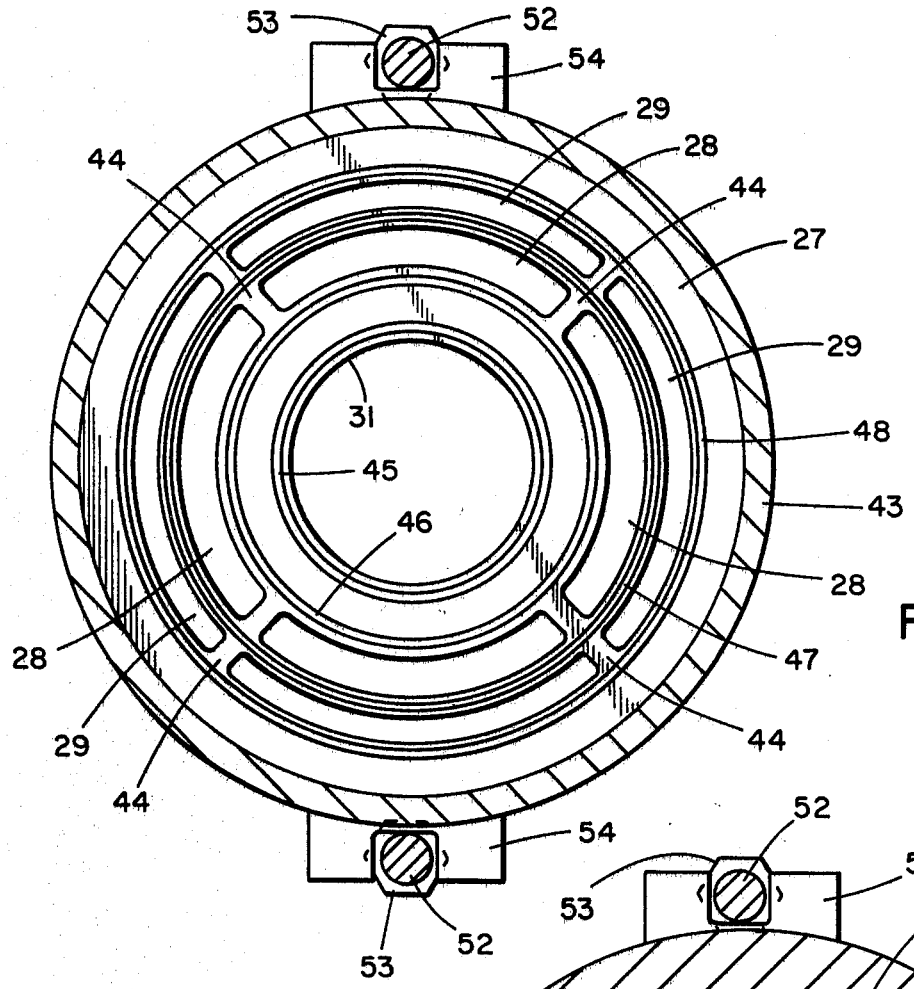
FIG. 4 is a cross sectional view taken along the line 4—4 of FIG. 3.

As indicated in FIG. 4 the inlet and outlet slots are of arcuate shape and adjacent ends of a pair of slots are separate by radially extending webs 44. A plurality of radially spaced O-rings 45, 46 are provided in suitable ring recesses inwardly of the slots 28. Another O-ring 47 is placed in a surface recess ring in the surface 27 between slots 28 and 29, and another O-ring 48 is disposed outwardly of the slot 29 in a suitable O-ring recess. Thus all the critical leakage areas are protected by the O-rings described.

Figure 3:
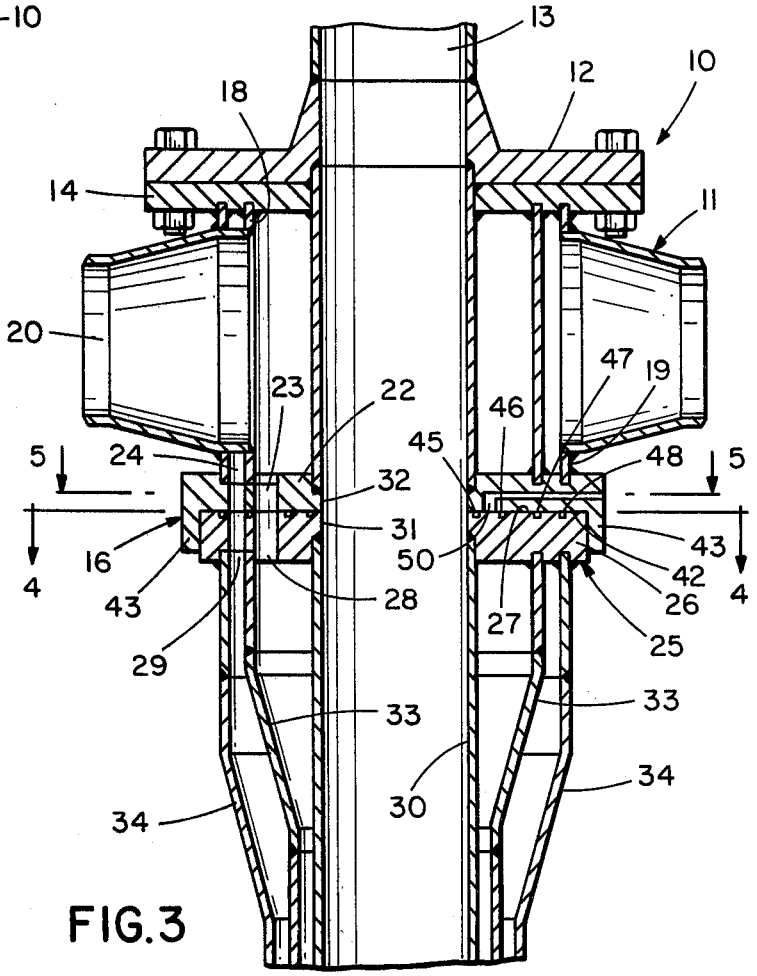
FIG. 3 is a cross sectional view of an upper portion of the oxygen lance.
Figure 5:
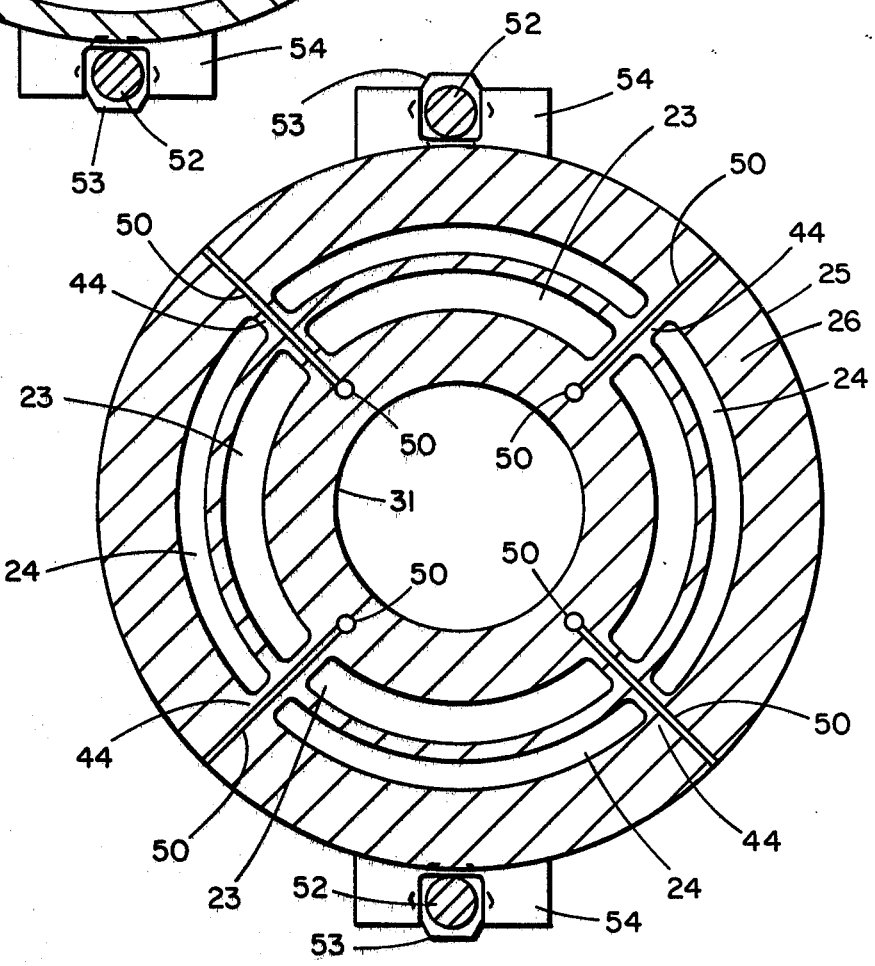
FIG. 5 is a cross sectional view taken along the line 5—5 of FIG. 3.

As best shown in FIGS. 3 and 5, a vent passage 50 is provided in each of the webs 44 and extend outwardly in the plate 26 to the atmosphere. The inward end of the vent passage is connected to a vertical bore 50 extending to the surface 27 between the slots 45 and 46. Thus any leakage of oxygen or water is vented to the atmosphere. Thus oxygen leaks cannot leak into water and water cannot leak into the oxygen.

The quick connect disconnect arrangement for the lance includes a pair of bosses 51 connected to pipe 19 which hingedly support bolts 52 having lower threads and nuts 53. Slotted keeper ears 54 are supported on the pipe 34 and are adapted to securely clamp the connector plates in firm connected relation.

DETAILED DESCRIPTION OF A MODIFIED EMBODIMENT

Figure 7:
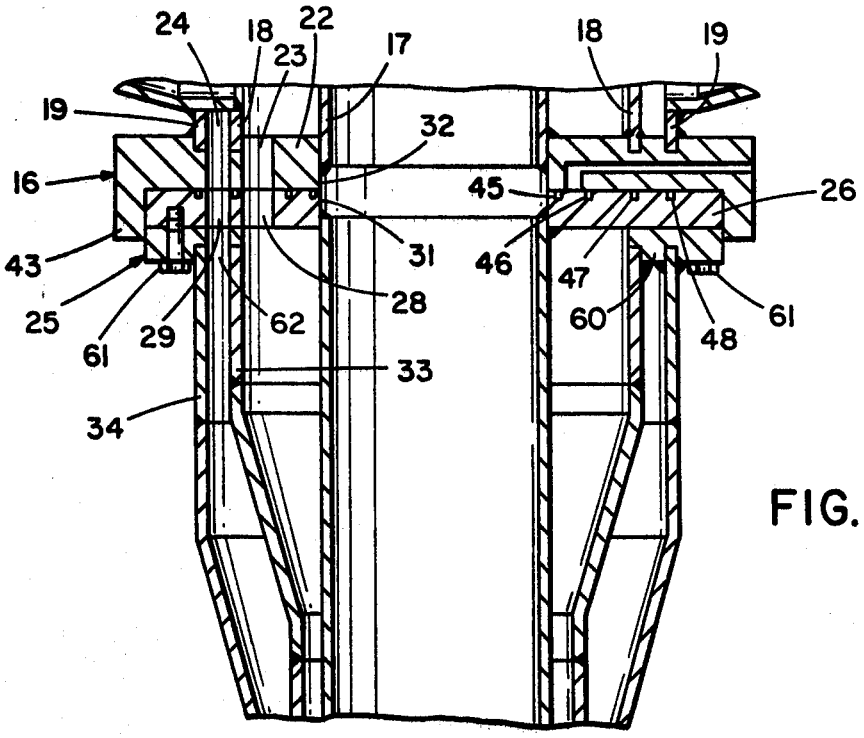
FIG. 7 is a cross sectional view of a modified lance disclosing the upper portion thereof.
Figure 6:
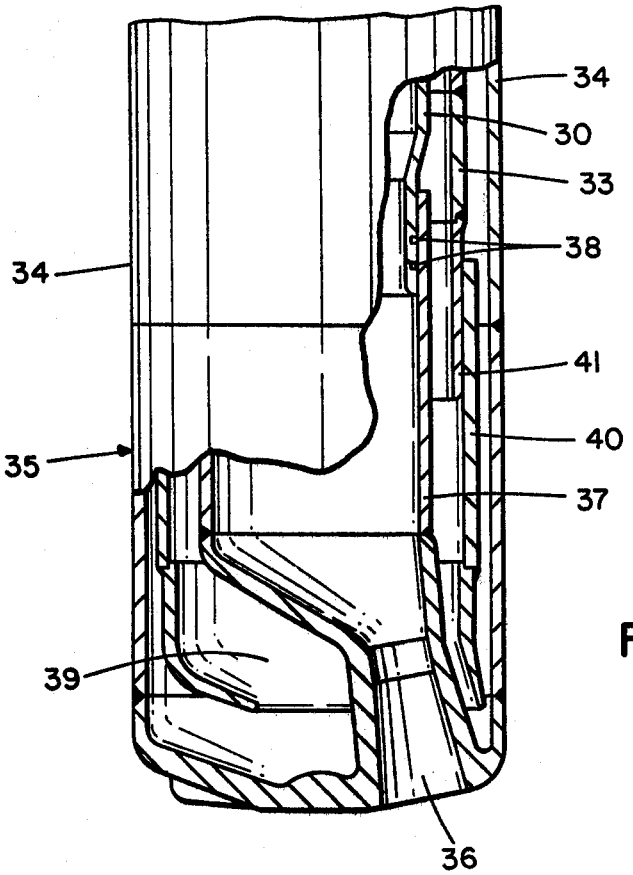
FIG. 6 is a cross sectional view taken along the line 6—6 of FIG. 1.

FIG. 7 discloses a cross sectional view of a modified form of the invention wherein the same reference characters are applied to similar parts. In this improvement a separate ring 60 is connected to the upper ends at the pipes 33 and 34, said ring being attached to the plate 26 by means of cap screws 61. The ring is also provided with arcuate slots 62 communicating with slots 29 to direct water outwardly through said water outlet connector.

THE OPERATION

The operation of directing oxygen and water through the lance is conventional. The improvement resides in the arrangement of the upper and lower connector assemblies with the slots which are placed in alignment or registry when the plates are connected in clamped relation by the improved clamping arrangement. By merely disconnecting the bolts the lower connector assembly and major portion of the lance can be removed for repairs, replacement, transport or other service; and similarly, by providing a slip joint at the lower end of the oxygen pipe, the invention accommodates quick removal, repair, and replacement of the tip assembly. Thus only one lance carriage need be employed with the top support head remaining in position. O-rings and other parts can be easily replaced. The slots are easily registerable and the vent arrangement is positive in the event leakage would occur.

What is claimed is:

1. A steel making lance assembly comprising a top support member, said support member including a first central oxygen supply pipe, and second and third water inlet and outlet pipes, a first connector plate assembly on said top support member, said first plate assembly having a lower flat surface including a central opening communicating with said first supply pipe, said lower surface including a plurality of first openings communicating with said second and third pipes, a second connector plate assembly, said second connector plate assembly including a flat upper surface including a second central opening registering with said first central opening, said flat upper surface including a plurality of second openings registering with said first circumferential openings, a fourth oxygen pipe having an upper end portion communicating with said second central opening and said first oxygen pipe, fifth and sixth water inlet and outlet pipes connected to said second connector plate assembly and communicating with said second opening, means quick releasably connecting said first and second connector plate assemblies whereby said openings in said flat surfaces are clamped in registering relation, a lance nozzle connected to said fourth, fifth and sixth pipes including a water chamber communicating with said fifth and sixth pipes, a discharge orifice, an oxygen pipe stub on said nozzle communicating with said orifice, said pipe stub and the lower portion of said fourth oxygen pipe being positioned in relative telescoping sliding relation, and a vent passage in one of said connector plate assemblies, said vent terminating at one end of said flat upper surface of said second connector plate assembly.

2. The invention in accordance with claim 1, said vent passage being provided in said first connector plate assembly.

3. The invention in accordance with claim 2, said vent extending horizontally to one peripheral end of said first connector plate assembly.

4. The invention in accordance with claim 1, said openings in said first flat lower surface being of arcuate configuration and terminating at their ends in spaced relation to provide spaced webs therebetween, and said vent passage being disposed in said spaced webs.

5. The invention in accordance with claim 1, said first connector plate assembly having a downwardly projecting peripheral flange overlapping said second connector plate assembly.

6. The invention in accordance with claim 1, said openings comprising a plurality of radially spaced concentric slots.

7. The invention in accordance with claim 1, said openings in said flat surfaces of said plate assemblies being of arcuate configuration and having their ends in spaced relation to provide intervening webs circumferentially spaced, and a vent passage terminating at one of said flat surfaces between said inlet and water passages and extending horizontally through certain of said webs to the atmosphere.

8. The invention in accordance with claim 1, including means removably connecting said fifth and sixth pipes to said second plate assembly.

9. The invention in accordance with claim 8, said means comprising a ring connecting member rigidly connected to upper ends of said fifth and sixth pipes, and screw type fastener means connecting said connector member to said second plate assembly.

* * * * *